US009227121B1

(12) United States Patent
Laurie et al.

(10) Patent No.: US 9,227,121 B1
(45) Date of Patent: Jan. 5, 2016

(54) SELF-SUPPORTING POCKET MOLDING DEVICE FOR LACROSSE STICKS

(71) Applicant: Robert Laurie, Joseph Gabrysiak and Roy Ragusa, a partnership, Syosset, NY (US)

(72) Inventors: Robert Laurie, Wantagh, NY (US); Joseph Gabrysiak, Wantagh, NY (US)

(73) Assignee: Robert Laurie, Joseph Gabrysiak and Roy Ragusa, a partnership, Syosset, NY (US)

( * ) Notice: Subject to any disclaimer, the term of this patent is extended or adjusted under 35 U.S.C. 154(b) by 31 days.

(21) Appl. No.: 14/055,783

(22) Filed: Oct. 16, 2013

(51) Int. Cl.
*A63B 59/02* (2006.01)
*A63B 59/00* (2015.01)

(52) U.S. Cl.
CPC ..... *A63B 59/0074* (2013.01)

(58) Field of Classification Search
CPC ..... A63B 59/02
USPC ..... 473/505, 510, 513
See application file for complete search history.

(56) References Cited

U.S. PATENT DOCUMENTS 1,165,216 A 12/1915 Weflen
4,938,478 A * 7/1990 Lay ..... A63B 69/0091 473/423
5,265,871 A 11/1993 Hanley
5,421,493 A 6/1995 Ebeling, II
5,425,541 A * 6/1995 Ambros ..... A63B 59/02 100/289
5,492,321 A 2/1996 Cipriano
5,638,999 A * 6/1997 Greene ..... A63B 71/143 223/78
6,006,962 A * 12/1999 Ebeling, II ..... A63B 71/143 223/78
6,138,879 A * 10/2000 Breuner ..... A63B 43/02 223/25
6,398,671 B1 * 6/2002 Rios ..... A63B 69/0075 273/317.6
6,551,204 B1 * 4/2003 Di Re ..... A63B 69/0002 473/417
7,244,200 B2 * 7/2007 Goldberg ..... A63B 59/025 473/513
7,445,571 B2 * 11/2008 Winningham ..... A63B 59/02 473/513
7,972,228 B1 * 7/2011 Dikmanis ..... A63B 59/02 473/513
2008/0254917 A1 * 10/2008 Fischer ..... A63B 69/0075 473/417
2014/0349789 A1 * 11/2014 Szurley ..... B32B 37/185 473/513
2015/0005113 A1 * 1/2015 Day ..... A63B 59/02 473/513

OTHER PUBLICATIONS

Webpage download, insidelacrosse2006, 2006, forums.insidelacrosse.com/showthread.php?45385- Best- way- to- stretch- a- lacrosse- pocket, 3 pages.*

(Continued)

*Primary Examiner* — Gene Kim
*Assistant Examiner* — M Chambers
(74) *Attorney, Agent, or Firm* — Alfred M. Walker

(57) ABSTRACT

A self-supporting pocket molding device for lacrosse sticks includes a weight ballasted hollow base, a support portion atop the base, and at least a hemisphere approximately the size of lacrosse ball at the top distal end. The base is preferably of a conical shape and the end sphere is attached up from the ground for ergonomic considerations of ease of use in a standing or sitting position. The shape of the self-supporting pocket molding device insures totally unencumbered access to the top surface of the sphere where the netting is easily forced down at the desired location to stretch the net forming a pocket. Both hands of the user are free to be used to hold the lacrosse stick or head; which also affords the ability to tilt the head as desired to stretch the netting in any sideways direction to correct any local deformation of the netting.

18 Claims, 4 Drawing Sheets

(56) References Cited

OTHER PUBLICATIONS

Brine Pocket Stretcher, Item # MS1031204, LacrosseMonkey.com, 2013, lacrossemonkey.com/brine-lacrosse-ac-pocket-stretcher.html?utm_source=goog . . . .

Warrior Lacrosse Pocket Pounder, Item No. 10928397, 2013, dickssportinggoods.com/product/index.jsp?productId=10928397&gsidynamic=.

* cited by examiner

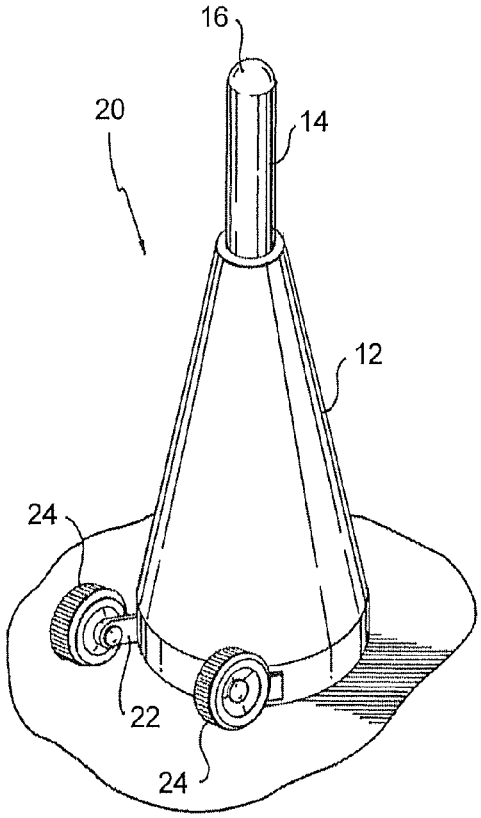
Fig. 5
Fig. 6
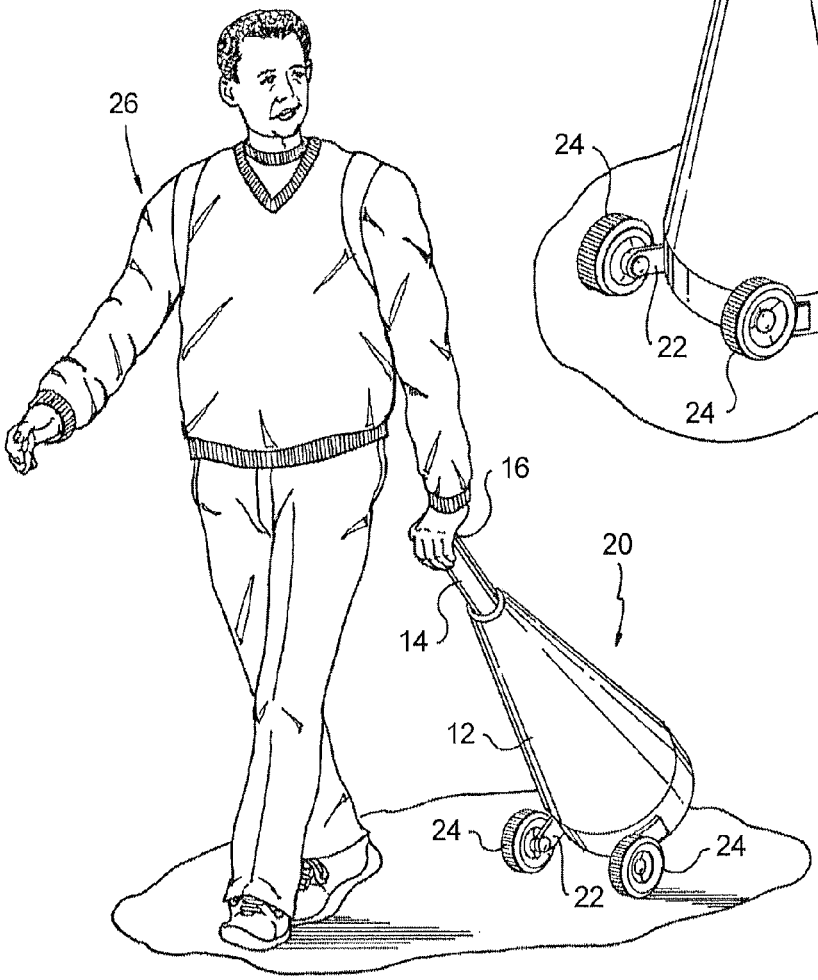

SELF-SUPPORTING POCKET MOLDING DEVICE FOR LACROSSE STICKS

FIELD OF THE INVENTION

The present invention relates to a self-supporting pocket molding device for lacrosse sticks.

BACKGROUND OF THE INVENTION

The leather or plastic netting fibers of a lacrosse stick head often tighten up, especially in wet weather conditions. The netting pocket then loses its elasticity and concavity.

Prior art has addressed this problem or similar ones for other sports with devices for stretching the netting.

U.S. Pat. No. 5,425,541 of Ambros shows a hand-held lacrosse stick pocket former that uses a hemispheric form of similar radius to a lacrosse ball attached to one end of a threaded rod which is also engaged with a threaded bracing crosspiece which braces across the frame of the head. Once the desired location for the ball pocket is selected by placing the hemisphere over the spot, the threaded rod is turned by a knob at the distal end thereby driving the hemisphere into the net. Upon information and belief, this product is sold as the "Brine Pocket Stretcher", item number MS 1031204 at sporting goods stores.

U.S. Pat. No. 6,138,897 of Breuner describes a mallet tool and method whereby the tool with a spherical shape and size as the ball used in the sport at one end is used to pound a sports glove repeatedly to break it in. This was designed for the sports of baseball or softball, but subsequently a similar device has been commercialized for use with lacrosse heads in the "Warrior Lacrosse Pocket Pounder", sold at Dicks Sporting Goods® and other sporting goods establishments.

U.S. Pat. No. 7,244,200 of Goldberg reveals a hand-held lacrosse stick pocket creator using a short stick with a ball at one end and a cross rod that is inserted transversely under the lacrosse head frame. By employing a lever action using the cross rod as a fulcrum, the ball end is driven into the mesh of the net to stretch it and form a pocket.

No prior art noted above describes a self-supporting pocket molding device for lacrosse sticks.

OBJECTS OF THE INVENTION

It is therefore an object of the present invention to provide a self-supporting pocket molding device for maintaining and restoring the concavity of the netting of lacrosse sticks.

It is also an object of the present invention to provide a lacrosse netting molding device which utilizes a stable base and which promotes the user's ability to use both hands while reconditioning and molding the lacrosse stick netting into a desired, supple concave shape.

It is also an object of the present invention to allow a user to place a lacrosse netting pocket over a stable, upwardly extending distal ball, and to manually rotate the netting into an accurate desired concave shape from below, with the user's hands rocking the lacrosse stick head alternately up and down at each end of the head of the lacrosse stick, with the netting forming a desired concave shape.

Other objects which become apparent from the following description of the present invention.

SUMMARY OF THE INVENTION

In keeping with these objects and others which may become apparent, the device of this invention is a self-supporting (i.e. free-standing) conditioner/stretcher for a lacrosse stick netting pocket. While the prior art reveals hand-held devices to achieve a similar purpose, the advantages of the present invention will be apparent. Pounding a ball-end mallet into the lacrosse head is not a very accurate method of creating a pocket in a net where the player intended. The inventions of Ambros '541 and Goldberg '200 described above require the use of both hands and preferably a table support to accurately achieve the desired result; such a support platform is usually not available on the sidelines during a lacrosse game. In the present invention, a spherical member at the top of the device is rigidly presented while both hands are used to grasp either a detached head or an assembled lacrosse stick (with shaft) easily placing the netting in the desired location face down upon the end sphere.

This invention is comprised of a hollow base portion, a support portion atop the base portion, and a hemisphere approximately the size of one half of a lacrosse ball (2.5 inches diameter) at the top distal end. Optionally, a full sphere can be supplied approximately the size of a regulation lacrosse ball (2.5 inches diameter) at the top distal end. The base is preferably weight ballasted and of an upwardly tapering conical shape and the end sphere is attached approximately 36 inches from the ground for ergonomic considerations of ease of use in a standing position. The optional ballast can be any inert dense material such as sand, gravel, or concrete. The shape of the self-supporting pocket molding device insures totally unencumbered access to the top surface of the sphere where the netting is easily forced down at the desired location to stretch the net forming a pocket. Note that both hands are free to be used to hold the lacrosse stick or head; this also affords the ability to tilt the head as desired to stretch the netting in any sideways direction to correct any local deformation of the netting. In addition, while one hand and the top sphere support the netting, the other hand can be used on the outer side of the netting to smooth the contour against the spherical surface.

This device can be manufactured inexpensively of a rigid plastic resin such as polyvinyl chloride (PVC) or polypropylene. Ultraviolet resistant grades of any plastic resin used would be preferable for longevity.

In an alternate embodiment, a pair of wheels are attached near the bottom of the base to facilitate easy rolling on rough terrain by simply gasping the spherical ball end and tilting the base.

BRIEF DESCRIPTION OF THE DRAWINGS

The present invention can best be understood in connection with the accompanying drawings. It is noted that the invention is not limited to the precise embodiments shown in drawings, in which:

FIG. 5 is a side elevation of an alternate embodiment of the pocket molding device with optional added brackets and wheels;

FIG. 6 is a side elevation of the device of FIG. 5 tilted in a rolling position; and, FIG. 7 is a side elevation view of an alternate embodiment for a conical, stackable pocket molding device.

DETAILED DESCRIPTION OF THE INVENTION

The present invention has broad applications for a variety of self supporting articles for maintaining the concavity of the netting portion of a lacrosse game stick. For illustrative purposes only, a preferred mode for carrying out the invention is described herein, wherein a self-supporting pocket molding device for lacrosse sticks is provided.

Figure 1:
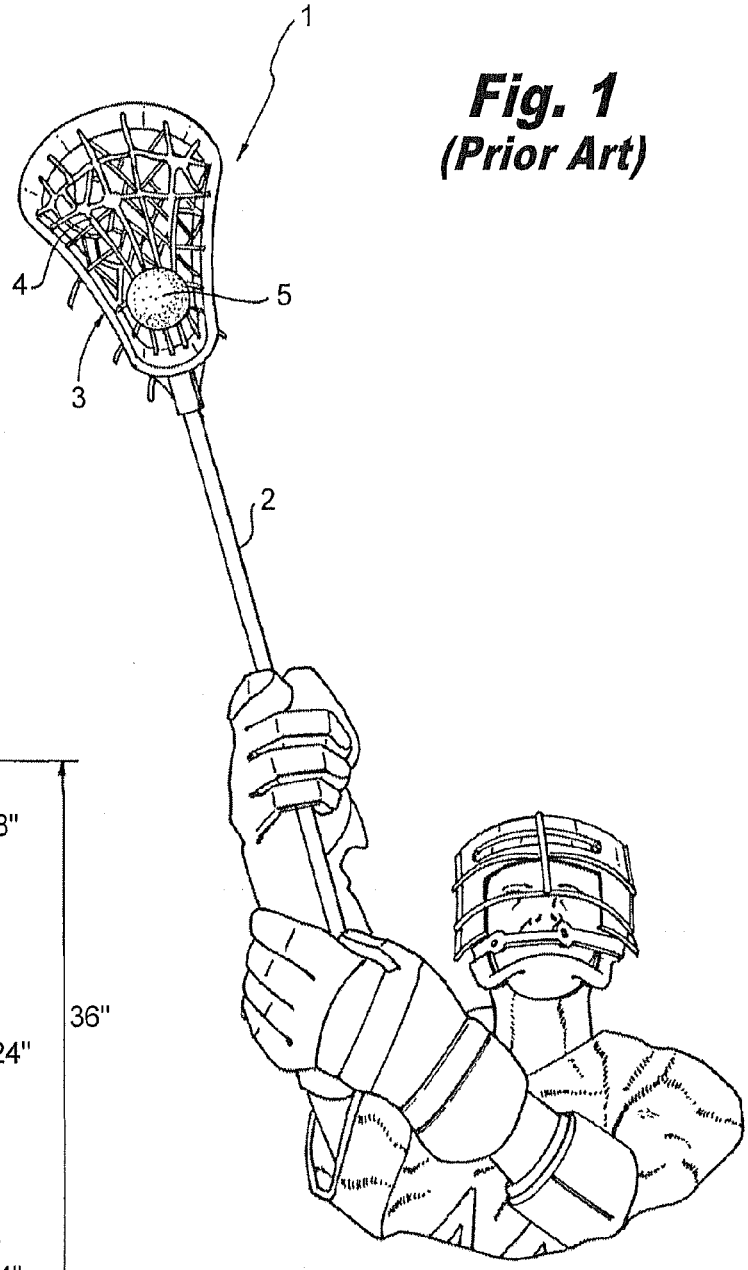
Fig. 1 (Prior Art)
FIG. 1 is a perspective view of a lacrosse stick with ball just prior to commencing with a forward motion or swing.

FIG. 1 shows lacrosse stick 1 with shaft 2, head 3, netting 4, and ball 5 nestled toward the bottom (shaft end) of head 3. In this position, prior to a swing, gravity will position ball 5 as shown. When the forward swing commences, ball 5 will actually rise in net 4 and be nestled in the desired "sweet spot" formed pocket for the swing.

Figure 2:
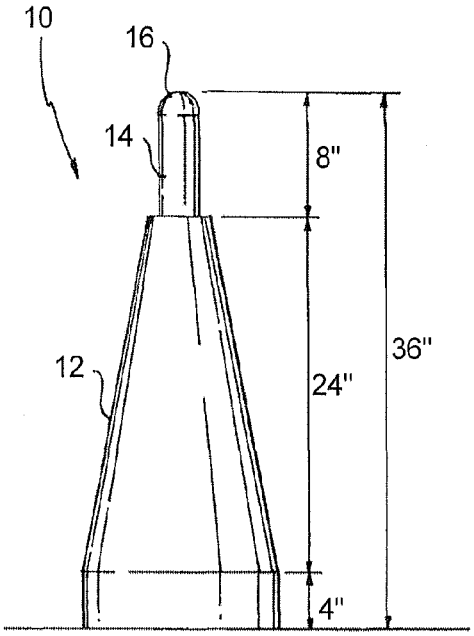
FIG. 2 is a side elevation of the pocket molding device of this invention with preferred dimensions.

The ball pocket in the net can be formed using the device 10 of this invention shown in FIG. 2. It is comprised of a lower hollow base 12 with a cylindrical band and a conical section, an upper support portion, such as rod 14, and an attached sphere 16 which is approximately the same size as a lacrosse ball. Although other dimensions may be used, the dimensions shown are ergonomically determined for convenient use in a standing position, although the dimensions also permit use in a sitting position. It is noted that sphere 16 can be either a hemisphere or a full sphere, or any geometric partial spherical portion therebetween, as long as the net 4 contacts at least a hemisphere.

Figure 3:
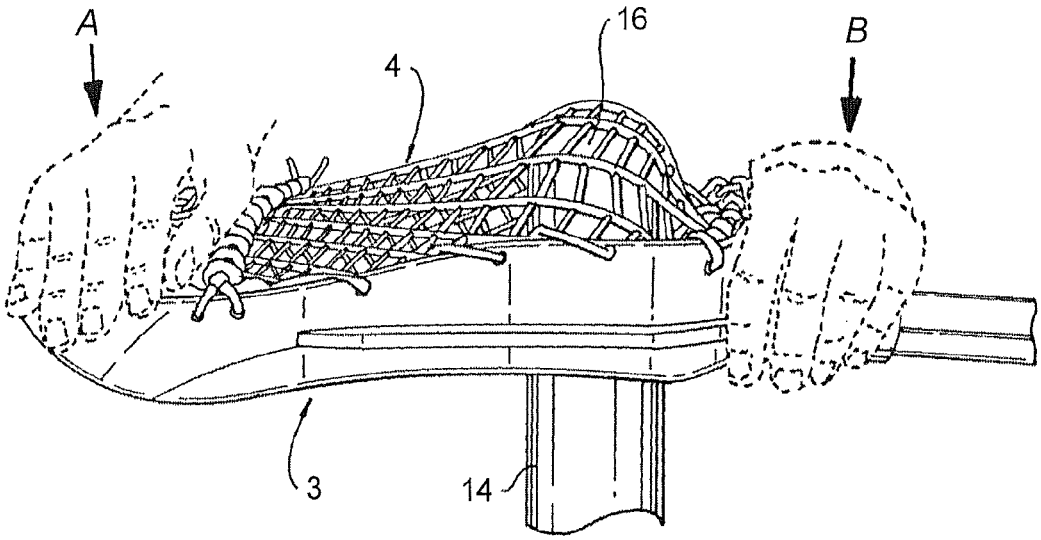
FIG. 3 is a perspective side detail of the pocket molding device in use on a detached lacrosse head showing the position of two hands at A and B (in phantom outline) to form a ball pocket toward the shaft end.
Figure 4:
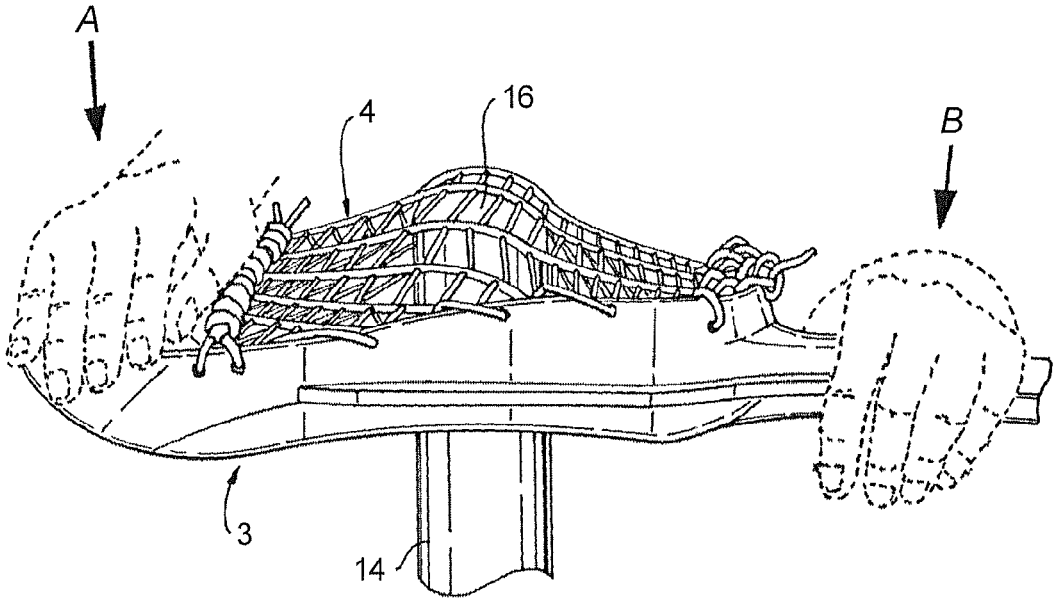
FIG. 4 is a perspective side detail of the pocket molding device in use on a lacrosse stick with shaft attached to form a pocket in the center of the net.

FIGS. 3 and 4 show detailed views of the method of use to create ball pockets in two different regions of net 4 by ball end 16 attached to an upper support portion, such as for example, rod 14. Note that in FIG. 3, device 10 is used to create a ball pocket on a detached head, while in FIG. 4 it is used on an assembled lacrosse stick. Note also the position of hands at A and B (in phantom outline). In these views, ball end 16 is held immobile by virtue of the ballast in base 12.

FIGS. 5 and 6 relate to an alternate embodiment of pocket molding device 20 with a pair of wheels attached to facilitate easy rolling on rough terrain which may be encountered on the lacrosse sidelines. FIG. 5 shows a side view in the use configuration with base 12 firmly in contact with the ground. Note that wheel 24 (one of a pair) attached to base 12 via bracket 22 is not in contact with the ground. (Only one of two wheels is shown in this view.) To roll device 20 to another location, the player 26 would simply grasp ball end 16 and tilt it in the direction shown so that wheels 24 now contact the ground and base 12 is lifted out of contact with the ground. Note that the tilting force required is minimal since the pulling location at the top provides good leverage.

Figure 7:
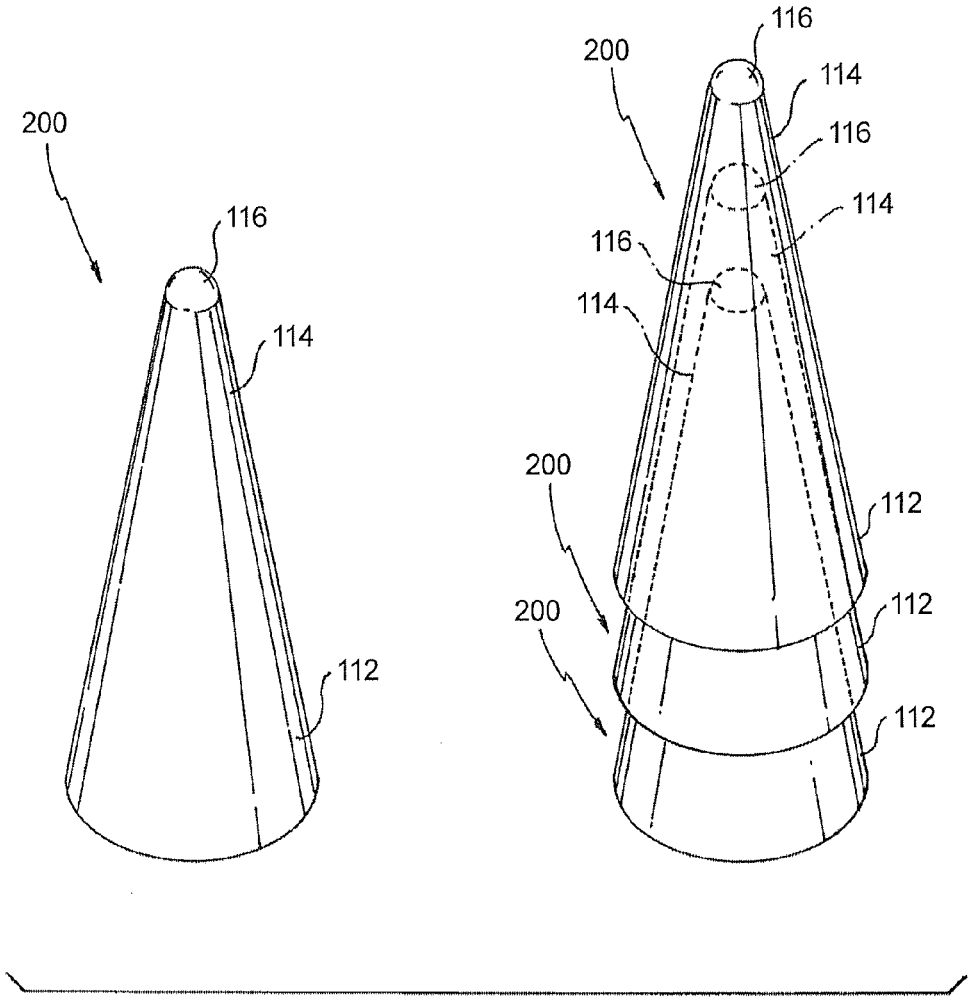

FIG. 7 shows an alternate embodiment for a conical, stackable version 200 of a pocket molding device, which includes a hemispherical top end 116 forming an apex of a cone, an upper support portion region 114 and a wider base portion region 112, wherein the wider base portion ends in a circle at a bottom thereof. Conical pocket molding device 200, like pocket molding device 10 or 20, can be provided with or without wheels. FIG. 7 shows a single pocket molding device 200 on the left and a stack of three stacked pocket molding devices 200 on the right.

In the foregoing description, certain terms and visual depictions are used to illustrate the preferred embodiment. However, no unnecessary limitations are to be construed by the terms used or illustrations depicted, beyond what is shown in the prior art, since the terms and so illustrations are exemplary only, and are not meant to limit the scope of the present invention.

It is further known that other modifications may be made to the present invention, without departing the scope of the invention, as noted in the appended Claims.

We claim:

1. A self-supporting pocket molding device in combination with a lacrosse stick comprising:

a weight ballasted hollow base, a support portion atop the base, and an end comprising at least a hemisphere of a spherical ball approximately the size of lacrosse ball located at a top distal end of said support rod wherein said spherical ball has approximately a 2.5 inch diameter;

said base being of a conical shape and said end sphere being attached up from the ground for ergonomic considerations of ease of use in a standing or sitting position;

said self-supporting pocket molding device providing unencumbered access to a top surface of said end comprising at least a hemisphere of said spherical ball when the netting of a lacrosse stick is forced down at a desired location to stretch the netting into forming a concave pocket for catching thrown lacrosse balls therein;

whereby both hands of the user are free to be used to hold the lacrosse stick or head, thereby affording the ability to tilt the head of the lacrosse stick as desired to stretch the netting in any sideways direction over said end spherical ball, and to correct any local deformation of the netting.

2. The self-supporting pocket molding device for lacrosse sticks as in claim 1 wherein said base is of an upwardly tapering conical shape.

3. The self-supporting pocket molding device for lacrosse sticks as in claim 1 wherein said at least hemispherical portion of said distal end spherical ball is attached approximately 36 inches from the ground for ergonomic considerations of ease of use in a standing or sitting position.

4. The self-supporting pocket molding device for lacrosse sticks as in claim 1 wherein said device is made of a rigid plastic resin.

5. The self-supporting pocket molding device for lacrosse sticks as in claim 4 wherein said rigid plastic resin selected from the group consisting of polyvinyl chloride (PVC) and polypropylene.

6. The self-supporting pocket molding device for lacrosse sticks as in claim 1, further comprising a pair of wheels being attached near the bottom of said base to facilitate rolling on rough terrain by gasping said at least hemispherical portion of said distal spherical ball end of said device and tilting said base.

7. The self-supporting pocket molding device as in claim 5 wherein said weight ballasted base is filled with a weighted ballast selected from the group consisting of sand, gravel and concrete.

8. A stackable self-supporting pocket molding device in combination with a lacrosse stick comprising:

a hollow base forming a cone converging at an upper apex comprising at least a hemisphere of a spherical ball approximately the size of lacrosse ball having a diameter of approximately a 2.5 inches located at said upper apex of said conical hollow base;

said end hemisphere being attached at said apex of said conical hollow base up from the ground for ergonomic considerations of ease of use in a standing or sitting position;

said self-supporting pocket molding device providing unencumbered access to a top surface of said end comprising at least a hemisphere of said spherical ball when the netting of a lacrosse stick is forced down at a desired location to stretch the netting into forming a concave pocket for catching thrown lacrosse balls therein;

whereby both hands of the user are free to be used to hold the lacrosse stick or head, thereby affording the ability to tilt the head of the lacrosse stick as desired to stretch the netting in any sideways direction over said end spherical ball, and to correct any local deformation of the netting.

9. The self-supporting pocket molding device for lacrosse sticks as in claim 8 wherein said at least hemispherical portion of said distal end spherical ball is attached approximately 36 inches from the ground for ergonomic considerations of ease of use in a standing or sitting position.

10. The self-supporting pocket molding device for lacrosse sticks as in claim 8 wherein said device is made of a rigid plastic resin.

11. The self-supporting pocket molding device for lacrosse sticks as in claim 10 wherein said rigid plastic resin selected from the group consisting of polyvinyl chloride (PVC) and polypropylene.

12. The self-supporting pocket molding device for lacrosse sticks as in claim 8, further comprising a pair of wheels being attached near the bottom of said base to facilitate rolling on rough terrain by gasping said at least hemispherical portion of said distal spherical ball end of said device and tilting said base.

13. A method of using the device of claim 1 or 8 comprising the steps of:

providing a weighted ballasted hollow base;

extending a support portion atop said base, attaching at least an upper hemispherical portion of a spherical ball approximately the size of a lacrosse ball at an upper distal end of said support portion, positioning said self-supporting pocket molding device for lacrosse sticks so that both hands of a user are free to be used to hold the lacrosse stick or head; and tilting a head of said lacrosse stick as desired to stretch the netting in any sideways direction to correct any local deformation of the netting.

14. The method as in claim 13 further comprising the step of tapering a top of said base to provide lateral clearance away from the ball, contacting said netting, and alternately tilting and rocking said netting over said at least an upper hemispherical portion of said spherical ball until said netting assumes the desired concave shape.

15. The method as in claim 14 wherein said tapering of said base provides a conical base.

16. The method as in claim 13 further comprising the step of stacking said self-supporting pocket molding device after use upon another self-supporting pocket molding device.

17. The method as in claim 13 further comprising the step of using one hand of the user and said at least an upper hemispherical portion of said top spherical ball support said netting, the other hand of said user touching an outer side of said netting to smooth the concave contour of said netting against said at least an upper hemispherical portion of said top spherical surface of said spherical ball extending up upon said support portion from said base.

18. The method as in claim 13, further comprising the steps of grasping said lacrosse head having said netting with both hands and rocking said lacrosse head alternately up and down at a distance of about 36 inches above the ground.

* * * * *